US005819346A

United States Patent [19]

Lane

[11] Patent Number: 5,819,346

[45] Date of Patent: Oct. 13, 1998

[54] RECREATION UTILITY PILLOW

[76] Inventor: David Minton Lane, 5118 Brookwood Valley, Atlanta, Ga. 30309

[21] Appl. No.: 990,409

[22] Filed: Dec. 15, 1997

[51] Int. Cl.[6] ..... A47G 9/02

[52] U.S. Cl. ..... 5/639; 5/643; 5/645; 5/656

[58] Field of Search ..... 5/636, 639, 645, 5/656, 655.9, 904, 643; 4/571.1, 575.1

[56] References Cited

U.S. PATENT DOCUMENTS

D. 280,170 8/1985 Short .
D. 336,199 6/1993 Bazata, Jr. .
4,896,388 1/1990 Bard .
5,345,627 9/1994 Cammarata .
5,421,045 6/1995 Bowen .
5,499,417 3/1996 Wang .
5,644,807 7/1997 Battistella .

*Primary Examiner*—Michael F. Trettel
*Attorney, Agent, or Firm*—William B. Noll

[57] ABSTRACT

The disclosure is directed to a recreation utility pillow offering comfort, security and entertainment for the user thereof. The pillow of this invention is particularly adapted for use at the beach, or pool side, where such pillow includes a waterproof cover for use in or near water. The pillow utilizes a yieldable foam-like material to give comfort to the user, includes an audio transmitter and speaker to allow private listening, and further includes storage facilities for personal items.

12 Claims, 2 Drawing Sheets

Fig. 3
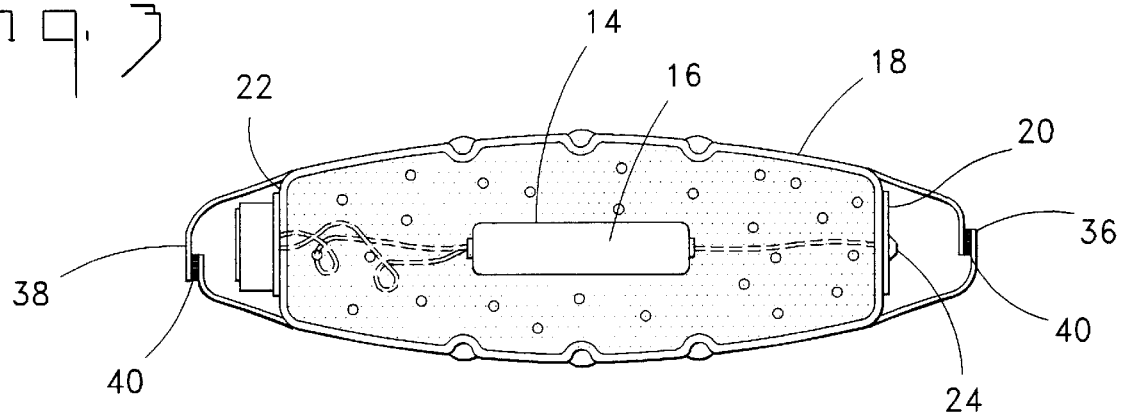
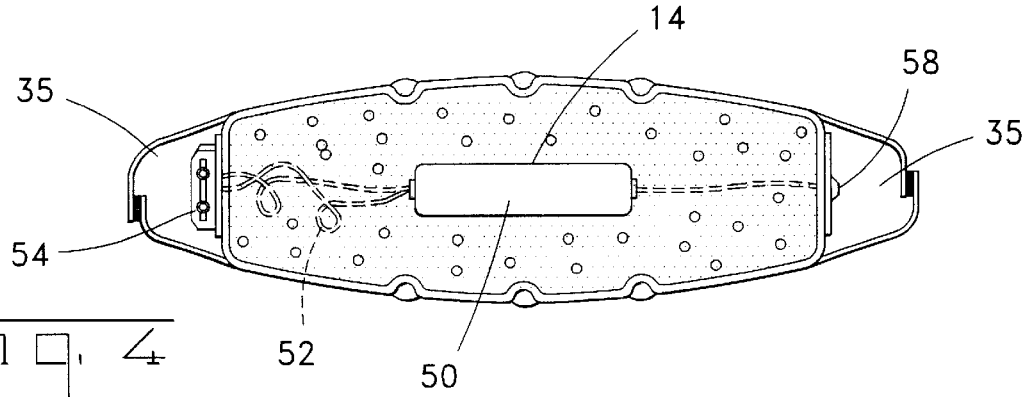
Fig. 4
Fig. 5
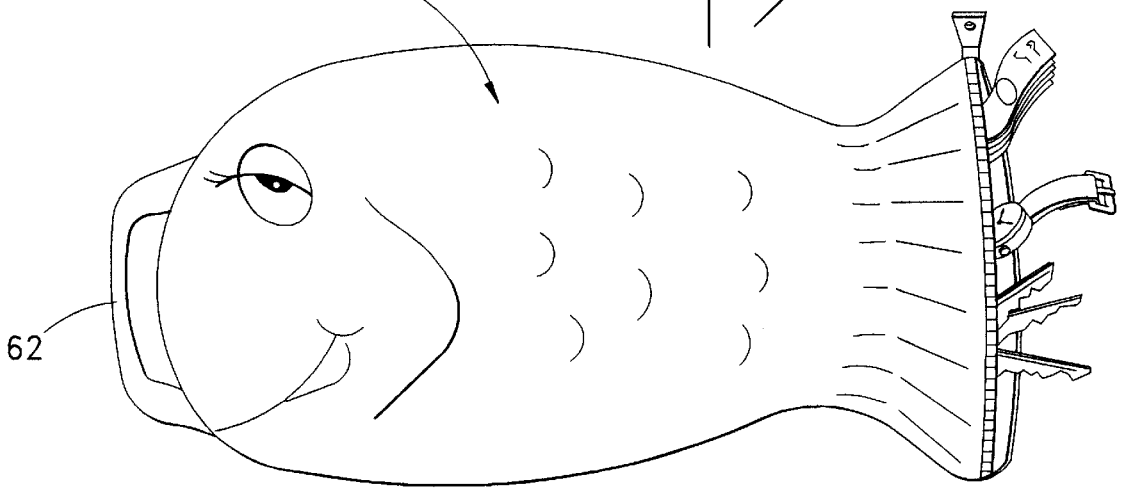

RECREATION UTILITY PILLOW

FIELD OF THE INVENTION

The present invention relates to the field of recreational pillows, more particularly a sport or beach, floating pillow having article storage and controlled audio capabilities.

BACKGROUND OF THE INVENTION

This invention is directed primarily to a beach pillow that offers many utilitarian purposes to beach and water enthusiasts.

There are various types of pillows available to be used in different applications. Most of these pillows or pillow-like articles are stuffed with cotton or cloth and become misshaped with use. Further they are not particularly suitable for the beach where they may be subject to splashing.

Various attempts have been made to develop a variety of pillows, particularly to enhance the Joy and comfort of sunning on a beach or lounging by a pool. The attempts are reflected by a number of U.S. patents, as noted below.

U.S. Pat. No. 5,644,807, to Battistella, discloses a beach towel comprising a highly absorbent fabric with an inflatable pillow attached to the towel by means of a hook and loop type fastener, i.e. VELCRO type fastener, which allows for ease of attaching and detaching. The inflatable pillow may be manufactured of vinyl with welded seams which prevent air leakage after inflation and a velvet-like flocking material may be applied to give the vinyl a cloth-like feel. One edge of the pillow is provided with a series of storage compartments for small items to be carried, the small storage compartments being fastened by means of a VELCRO type fastener. The product thereof may be rolled up and bound by binding cords attached to one edge thereof U.S. Pat. No. 5,499,417, to Wang, discloses a multipurpose floating pillow including an ellipse dish-like lower member having a spherical recess formed on its top surface for receiving an inflatable sac therein. A molded and resilient upper member covers and engages with the lower member. A container may be disposed in a recess formed on the bottom side of the lower member to receive, for example, a weight scale. Pads made of slightly rigid material may be disposed between the inflatable sac and the upper member. The resiliency and softness of the floating pillow can be adjusted through the inflation of the inflatable sac. The floating pillow will therefore not deform after long periods of use and may provide different functions on different occasions.

U.S. Pat. No. 4,896,388, to Bard, discloses a pillow casing which cooperates with a conventional pillow to alter the characteristics of the combined pillow casing and pillow. In a preferred form thereof, the combination relates to the floating of a conventional pillow on a thin fluid-like layer located beneath the pillow.

Another type of development for beach use is a combined pillow and beach towel, which development is illustrated by the following U.S. patents.

U.S. Pat. No. 5,345,627, to Cammarata, discloses a beach pillow including a foam within a case enclosure covered by a terrycloth material so as to be machine-washable and dryable. In a preferred embodiment thereof, a bottom-side of the case is provided with a VELCRO type fastener to adhere to a complementary fastener on the facing side of a towel. This allows for the holding of the pillow in a substantially vertical position when the towel is drapped over a chair. A fastener at a corner extremity of the case permits the pillow to be easily carried about, and its temporary securement to a fixed object to be held thereby under varying wind conditions.

U.S. Pat. No. D-280,170, to Short, illustrates a combined beach towel and pillow, with a carrying strap.

U.S. Pat. No. D-336,199, to Bazata, Jr., also illustrates a different version of a combined beach towel and pillow, with carrying case.

While the foregoing prior art patents represent various useful products for liesure use at the beach or pool, they fail to provide the fill complement of uses as found in the present invention. The pillow hereof offers comfort, security and entertainment to the user. The manner by which this is achieved will become more apparent to those skilled in the art from the following description, particularly when read in conjunction with the accompanying drawings.

SUMMARY OF THE INVENTION

The present invention is directed to a leisure or recreation-type pillow for use at the beach, or pool side, to enhance the user's comfort thereat, while providing some security and entertainment to the user. The pillow comprises a yieldable, elongated, foam-like body having a central primary cavity supporting an audio transmitter and speaker, and a waterproof cover extending about the body. The pillow includes a pair of rigid panels disposed at opposite sides of the body, where the panels mount accessible means for powering and monitoring the audio transmitter. Further, a flexible cover is provided about each panel to define a pair of secondary cavities, where the flexible covers include means for accessing the secondary cavities from the exterior thereof The secondary cavities, while giving the user the ability to select a particular radio station, for example, also provides a means of storing such necessary items as a key, watch, etc. A further feature hereof is the provision of being able to privately listen to the radio, with the user's head placed on the pillow, without the tell tale signs of separate ear pieces. No one else is disturbed by the selection of music, for instance, that might be chosen by the user.

Accordingly, an object of this invention is to provide a comfortable, yet private setting for a person wishing to enjoy the sun at the beach or poolside.

A further object hereof lies in the use of a foam-like body for the pillow allows for the local transmission of sound from a contained speaker to a person whose head is positioned on the pillow.

Another object of this invention is the provision of a convenient means to safely secure valuable items within the pillow and avoid their loss through theft or misplacement.

Still another object of this invention is the provision of a waterproof cover to allow the use of the pillow in the water as a headrest, while at the same time being privately entertained by one's own selection of music.

These and other objects will become apparent to those skilled in the art from the following specification.

BRIEF DESCRIPTION OF DRAWINGS

FIG. 3 is a transverse sectional view of the first embodiment of FIG. 1.

FIG. 4 is a transverse sectional view of the second embodiment of FIG. 2.

FIG. 5 is a plan view of a beach, floating pillow of this invention, where the pillow has been externally designed and shaped to simulate a fish.

DETAILED DESCRIPTION OF PREFERRED EMBODIMENTS

Figure 1:
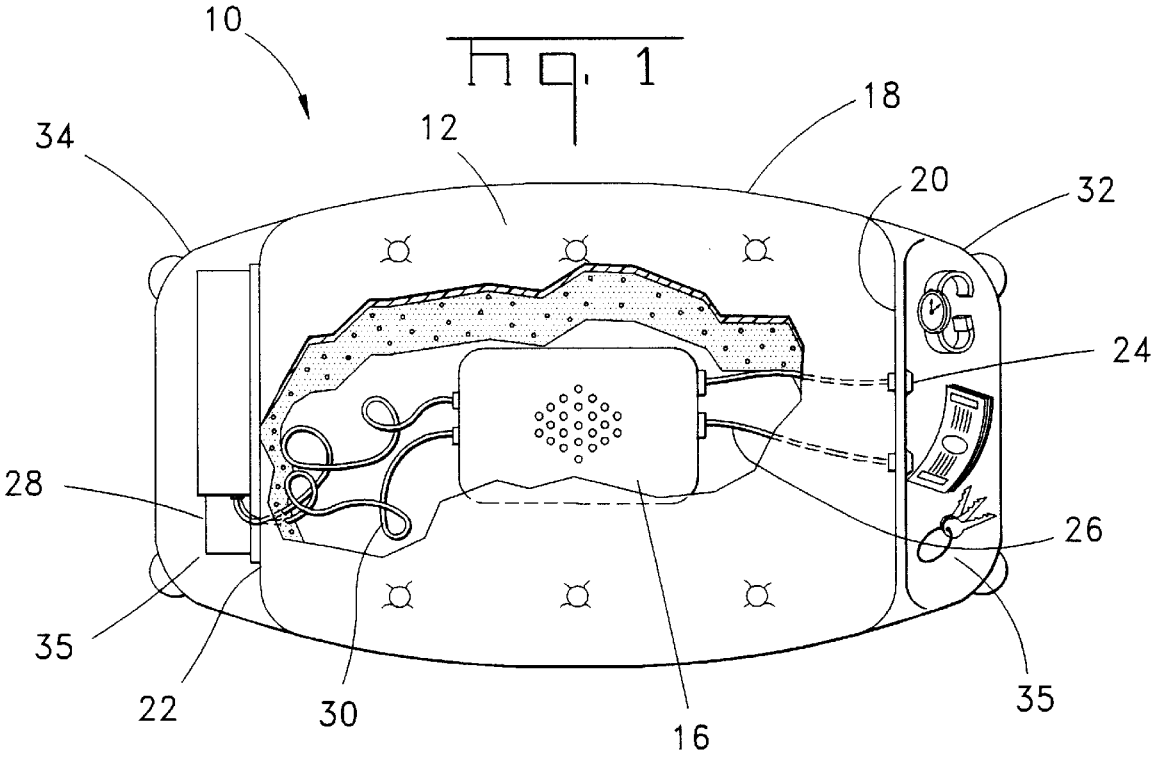
FIG. 1 is a top plan view, with parts removed, of a first embodiment for a beach, floating pillow according to the present invention, where such pillow offers storage and controlled audio capabilities.

The present invention is directed to a recreation utility pillow for use at the beach or poolside. The pillow hereof is illustrated in the several Figures, where like reference numerals depict like parts or features throughout the various views.

FIGS. 1 and 3 illustrate a first embodiment for a recreation utility pillow 10 according to this invention. The pillow 10 comprises a body 12 consisting of a yieldable foam-like material, such as polyester, of a sufficient thickness, such as four to six inches, to comfortably support a user's head when resting thereon. As best seen in FIG. 3, the body 12 includes a central primary cavity 14 to support an audio transmission device 16, such as a radio, and accompanying speaker. By the use of a foam-like material for the body 12, having a low density, it was readily determined that sound could easily pass therethrough to the exterior thereof. As will be apparent from the further description which follows, this allows for the private listening of the sounds from the speaker to one whose head rests upon the pillow.

To allow for water, as well as land use, the pillow 10 is provided with a waterproof cover 18, such as a sealed vinyl cover. Additionally, at respective sides of the pillow 10, a pair of rigid panels 20, 22 are provided. A first said panel 20 may include monitoring means, preferably in the form of plural rotary devices 24, connected to the audio transmission device 16 by flexible control conduits 26, whereby the user thereof can control, i.e. turn-on, turn-off and tune, the device 16.

The opposite panel 22 may include a portable, electrical power source 28, such as a battery pack, as known in the art. Connecting said power source 28 to said device 16 are plural conductors 30 passing through the body 12 to the cavity 14.

To provide some environmental protection to the panel mounted devices, and provide storage facilities for the user, such as for keys, watches, money, etc., the panels 20, 22 are surrounded by flexible, waterproof covers 32, 34, to form secondary cavities 35. To ensure access to the cavities 35, the respective covers may include closable openings 36, 38, where such openings may be provided with manual closure means 40, such as a zipper or a hook and loop type fastening mechanism, known commercially as a VELCRO type fastener, By simply opening the closure means, the user thereof can select the radio station desired, for example, set the volume, store personal items, then close the closure means to relax and enjoy the sun and/or water without disturbing others who may be nearby.

A convenient manner of assembling the pillow hereof is to manufacture a pair of hermaphroditic shell halves for the body, with each having a cavity half or central recess therein. The audio transmitter, i.e. radio, and speaker, may then be positioned within one of the central recesses, with the respective conductors and flexible control conduits placed along the mating surface of the body half. Thereafter, the second or mating body half is placed thereover and secured thereto to provide an integral body, then enclosed in a waterproof cover, as seen in FIGS. 1 and 3.

Figure 2:
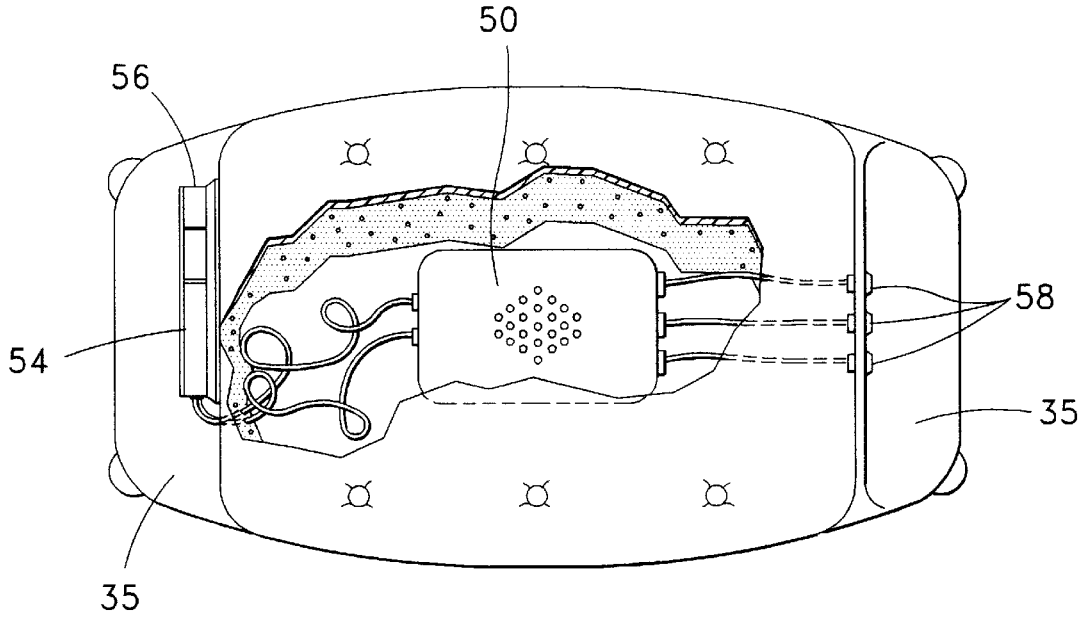
FIG. 2 is a top plan view, similar to FIG. 1, of a second embodiment for a beach, floating pillow of the invention hereof.

FIGS. 2 and 4 represent an alternate embodiment where a user may prefer to select his or her own music, for example. For this embodiment the central primary cavity 14 is provided with a speaker 50 electrically connected through conductors 52 to a cassette tape player 54, for example, and to an optional battery pack 56, within secondary cavity 35. The opposite end, or other secondary cavity, may be provided with control means 58 to monitor and control the level of music volume from the speaker 50

Finally, as noted previously, the appearance of the pillow can assume a variety of shapes, such as different living creatures, for example. FIG. 5 illustrates one such shape, namely, one simulating a fish 60. For this embodiment, only a single secondary cavity is preferred for both access to the radio controls, for example, and supporting components, and storage of personal items. This arrangement allows for the inclusion of a carrying strap 62 at the opposite end.

While several embodiments have been described above, it is recognized that variations may be had with respect to the components of the several embodiments for a recreation utility pillow in accordance with this invention. Therefore, while the invention has been disclosed in preferred forms only, it will be obvious to those skilled in the art that many additions, deletions and modifications can be made therein without departing from the spirit and scope of this invention, and that no undue limits should be imposed thereon except as set forth in the following claims.

I claim:

1. A recreation utility pillow adapted to provide comfort, security and entertainment to a user, said pillow comprising:

a.) a yieldable, elongated, foam-like body having a central primary cavity supporting an audio transmitter and speaker, and a waterproof cover extending about said body;

b.) a pair of rigid panels disposed at opposite sides of said body, where said panels mount accessible means for powering and monitoring said audio transmitter; and c.) a flexible cover about each said panel to define a pair of secondary cavities, where said flexible covers include means for accessing said secondary cavities from the exterior thereof.

2. The recreation utility pillow according to claim 1, wherein said means includes a hook and loop type fastening mechanism.

3. The recreation utility pillow according to claim 1, wherein said means includes a zipper.

4. The recreation utility pillow according to claim 1, wherein one of said panels mounts a sealed electrical power source connected to said audio transmitter.

5. The recreation utility pillow according to claim 4, wherein a second of said panels mounts plural rotary control devices connected to said audio transmitter by flexible control conduits.

6. A recreation utility pillow adapted to provide comfort, security and entertainment to a user, said pillow comprising:

a.) a yieldable, elongated, foam-like body having a central primary cavity supporting at least a speaker, and a waterproof cover extending about said body;

b.) at least one rigid panel disposed at a side of said body, where said panel mounts accessible means for monitoring and controlling said speaker;

c.) a flexible cover about said panel to define a secondary cavity, where said flexible cover includes means for accessing said secondary cavity from the exterior thereof; and d.) means for attaching a portable audio system within said secondary cavity, and for connecting to said speaker.

7. The recreation utility pillow according to claim 6, wherein said means includes a hook and loop type fastening mechanism.

8. The recreation utility pillow according to claim 6, wherein said means includes a zipper.

9. The recreation utility pillow according to claim 6, wherein said panel further mounts a sealed electrical power source for connection to said audio system.

10. The recreation utility pillow according to claim 6, wherein said pillow is shaped to simulate a living creature.

11. The recreation utility pillow according to claim 10, wherein said living creature is a fish.

12. The recreation utility pillow according to claim 10, wherein there is one said panel disposed at one end of said body, and at the opposite end a strap for transporting said pillow.

* * * * *